US005775408A

United States Patent [19]

Shimek et al.

[11] Patent Number: 5,775,408

[45] Date of Patent: Jul. 7, 1998

[54] INTEGRATED GAS FIREPLACE AND AIR CONDITIONER SYSTEM

[75] Inventors: Ronald John Shimek, Prior Lake; Daniel Curtis Shimek, Apple Valley, both of Minn.

[73] Assignee: Heat-N-Glo Fireplace Products Inc., Savage, Minn.

[21] Appl. No.: 588,865

[22] Filed: Jan. 19, 1996

[51] Int. Cl.[6] ..... F25B 29/00

[52] U.S. Cl. ..... 165/48.1; 165/58; 62/263; 126/512; 126/502; 126/509; 126/508; 126/521

[58] Field of Search ..... 165/48.1, 58; 62/263; 126/502, 508, 509, 512, 521

[56] References Cited

U.S. PATENT DOCUMENTS

| | | | |
|---|---|---|---|
| 4,004,731 | 1/1977 | Zung | 126/509 |
| 4,026,263 | 5/1977 | Boyd | 126/502 |
| 4,049,194 | 9/1977 | Tice et al. | 126/509 |
| 4,092,976 | 6/1978 | Buckner | 126/508 |
| 4,126,118 | 11/1978 | Haynes | 165/58 |
| 4,129,114 | 12/1978 | Hiser | 126/509 |
| 4,132,263 | 1/1979 | Stinnett | 165/48.1 |
| 4,179,065 | 12/1979 | Zung | 126/521 |
| 4,231,516 | 11/1980 | Weingartner | 165/901 |
| 4,793,322 | 12/1988 | Shimek et al. | 126/80 |
| 4,828,171 | 5/1989 | Akin, Jr. et al. | 165/58 |
| 4,916,918 | 4/1990 | Marelli | 126/500 |
| 5,000,162 | 3/1991 | Shimek et al. | 126/512 |
| 5,452,708 | 9/1995 | Shimek et al. | 126/512 |

*Primary Examiner*—John K. Ford
*Attorney, Agent, or Firm*—John B. Sowell-Attorney

[57] ABSTRACT

An integrated combined heating and cooling unit comprises a known high efficiency gas fireplace unit stacked on top of a known high efficiency window type air conditioning unit. Novel vent adapters are connected to the rear of the units for connecting them to a source of outside combustion and cooling air to effect high efficiency operations. Novel controls comprise a fireplace relay and an air conditioning relay mounted inside of each of the units. The relays control the on-off operation of the respective units and are actuated by a thermostatic control preferably located remote from the combined units.

18 Claims, 6 Drawing Sheets

INTEGRATED GAS FIREPLACE AND AIR CONDITIONER SYSTEM

BACKGROUND OF THE INVENTION

1. Field of the Invention

The present invention relates to combination heating and cooling units for use in a room or area to be heated or cooled. More particularly, the present invention relates to a combined prefabricated gas fireplace unit and a window type air conditioner unit controlled by a single thermostatic control.

2. Description of the Prior Art

Combination heating and cooling units for small hotel and motel rooms are well known and do not require a detailed description herein. The most common such units employ a single coil connected to a source of heating or cooling fluid located at a remote location. More recently, combined heating and cooling units employ electrical heating coils packaged in the same enclosure with special narrow configuration electrical air conditioners. Some such units employ a single blower and a single manual adjustable thermostat mounted in the same enclosure. The advantage of the latter type unit is that no pipes or plumbing are needed in the original installation. The disadvantage of this latter type unit is the high cost of the electrical power used for the electrical heating and air conditioning units. Further, such special shaped and packaged air conditioning units are initially high cost units which require high cost maintenance and repair and are not comparable in heating efficiency with the high energy efficiency rating (EER) units which are usually obtainable at low cost due to high production in the form of standard window units.

It would be highly desirable to provide a combination heating and cooling unit which integrates a very high efficiency and low cost gas fireplace unit to provide a combined unit which would have low maintenance and repair cost.

SUMMARY OF THE INVENTION

It is a principal object of the present invention to integrate a high efficiency, low cost, gas fireplace heating unit with a high efficiency, low cost air conditioning unit and a thermostatic control system to provide a combined gas fireplace and air conditioning unit.

It is another principal object of the present invention to provide an air conditioner adapter which permits a gas fireplace to be stacked on top of air conditioner unit and to locate the combined unit in a case or cabinet enclosure and maintain its intended high efficiency.

It is another principal object of the present invention to provide a stackable combination heating and cooling unit which may be flush mounted through an exterior wall or mounted as a zero clearance combined unit completely inside of an exterior wall of a space to be heated.

It is another principal object of the present invention to provide a novel control circuit or thermostat control system which operates the controls and valves normally found in commercially available gas fireplace units and window type air conditioning units.

According to these and other object of the present invention, there is provided an integrated combined heating and cooling unit which comprises a known high efficiency gas fireplace unit stacked on top of a known high efficiency window type air conditioner unit. Vent adapters are connected to the rear of the units to connect them to a source of outside combustion and cooling air to effect high efficiency operations. Controls which comprise a fireplace relay and an air conditioning relay are mounted inside of the combined units and are actuated by a thermostatic control unit located remote from the combined units.

DETAILED DESCRIPTION OF THE PREFERRED EMBODIMENT

Figure 1:
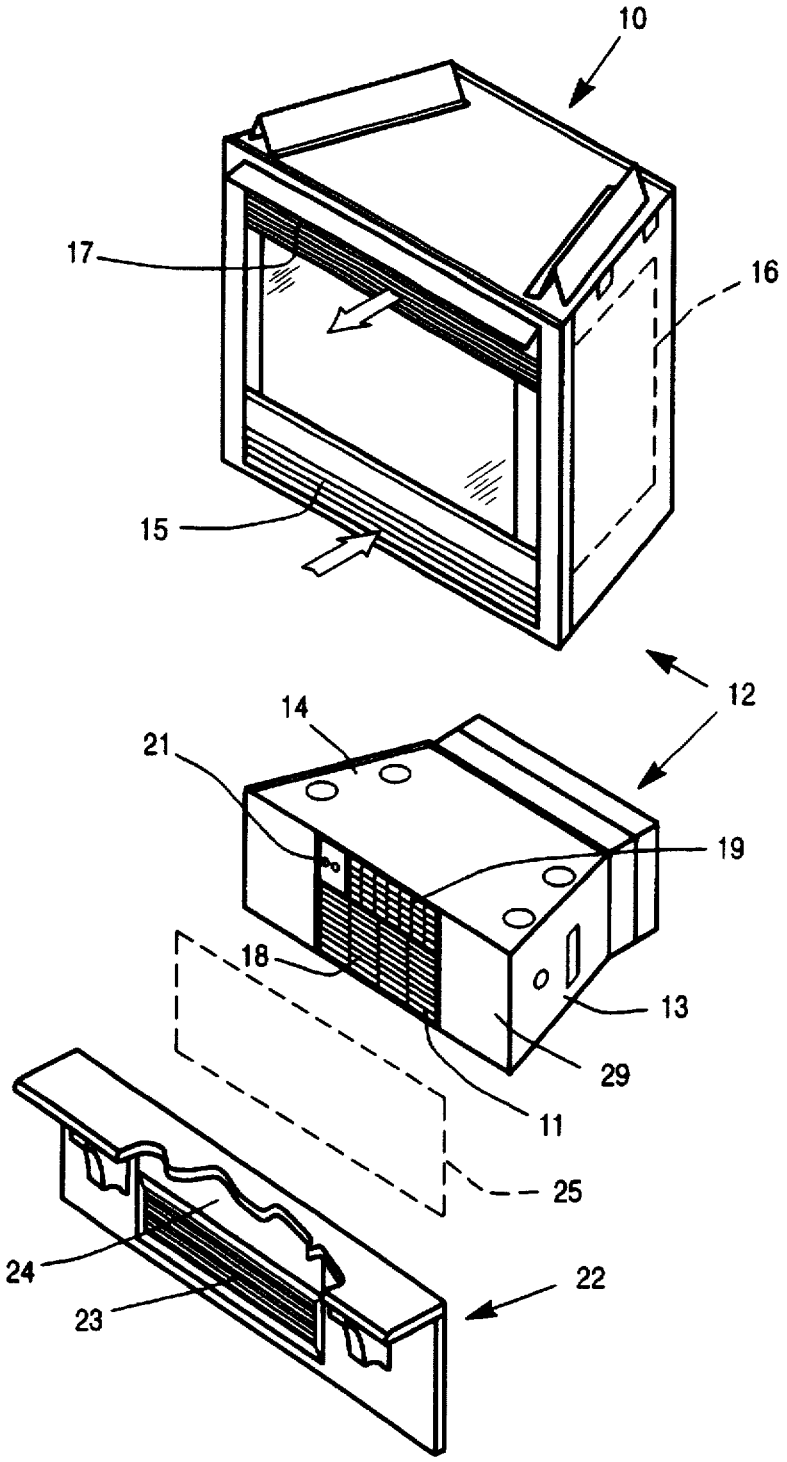
FIG. 1 is an exploded isometric view showing a fireplace unit and an air conditioning unit before integration into a combined unit.

Refer to FIG. 1 showing an exploded isometric view of a gas fireplace unit 10 and an air conditioning unit 11 before they are integrated into a combined unit 12. The gas fireplace unit 10 is preferably a high efficiency direct vent gas fireplace incorporating the features shown and described in my U.S. Pat. Nos. 4,793,322 and/or 5,452, 708 and/or 5,000,162 which are incorporated herein by reference.

An extension adapter 13 is shown as a plenum or duct surrounding the air conditioner whose front is shown enclosed by closure panels 29. The top panel 14 of the air conditioner adapter 13 forms the bottom panel of the gas fireplace unit 10 or may be provided as a separate panel. In either event, the gas fireplace unit 10 is stackable and nest on top of the extension adapter 13. When the gas fireplace unit 10 is operating, room air enters the bottom louvers 15 and passes around the bottom, back and top walls which form a heat exchanger 16 and is expelled out of the top louvers 17 so as to provide a high efficiency heating unit.

When the air conditioner 11 is operating, air enters the bottom louvers shown at 18 and is expelled as cold air out of the top louvers 19 as is well known. The operating controls 21 of the air conditioner 11 provide an on-off setting as well as a thermostatic setting and will be discussed in greater detail hereinafter. The preferred embodiment of the present invention includes a trim piece 22 which has the appearance of a hearth or lower mantle and is provided with a decorative louver or cover 23 which covers the bottom louvers 18 of the air conditioner 11. Preferably an opening 24 is provided above the louver 23 which permits direct access to the baffle and diversion controls of the louvers 19 of the air conditioner 11. In one preferred embodiment, the whole front panel incorporating louvers 18 and 19 is removed and a louver system is provided in the trim piece 22. In one preferred embodiment, there is provided an insulating sealing mat 25 which fits between the back of trim piece 22 to seal off cold air in the winter time without having to provide a seal or cover on the outside of the extension adapter 13. Accordingly, insulation 25 is adapted to mount on the back of trim piece 22 or across the front of adapter 13.

Figure 2:
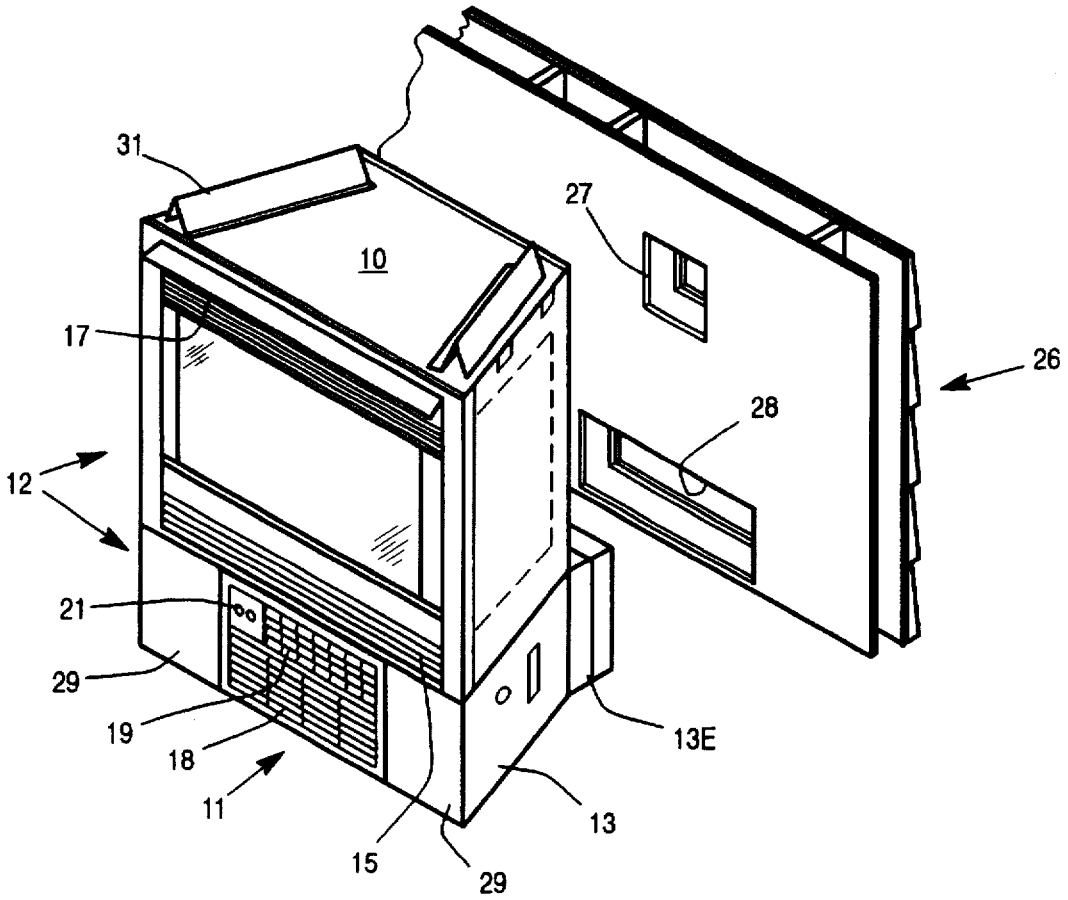
FIG. 2 is an isometric view of a preferred embodiment combined unit juxtaposed an outside wall before a zero clearance installation.

Refer now to FIG. 2 showing an isometric view of a preferred embodiment combined heating and cooling unit 12. The air conditioning unit is provided with an extension adapter 13 which terminates in a telescoping extension 13E which is capable of extending through variable thickness walls 26 at aperture 28. The gas fireplace unit 10 is provided with an exhaust and vent system on the rear (not shown) which extends through the aperture 27 of wall 26. The venting and exhaust system is of the type shown in numerous direct vent patents including our aforementioned U.S. Pat. No. 4,793,322. The numerals on the louvers and other pieces of the units 10 and 11 which are the same as those described with FIG. 1 are numbered the same.

Figure 3:
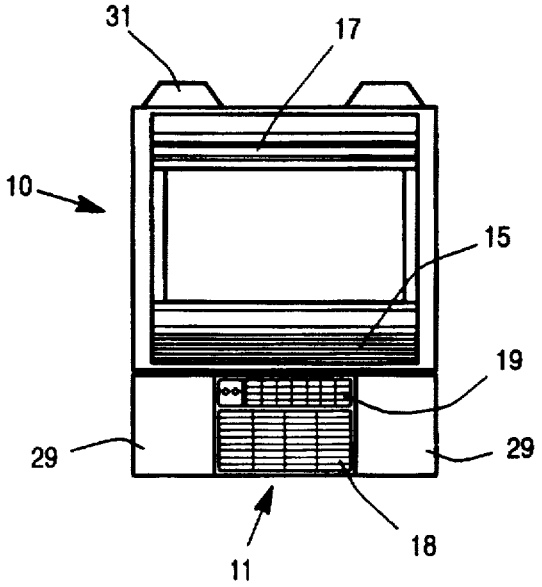
FIG. 3 is a front view of a preferred embodiment combined unit before being mounted against an outside wall or flush mounted through an outside wall.

Refer now to FIG. 3 showing a front view of a preferred embodiment combined heating and cooling unit 12 which comprises a known gas fireplace unit 10 and a known high efficiency air conditioner 11. The air conditioner 11 will always be more narrow in width than the width of the fireplace 10. Decorative closure panels 29 may be provided as part of the extension adapters 13 or can be provided as separate elements as will be explained in greater detail hereinafter. The fireplace units 10 are provided with stand-off angle plates 31 (or stand-offs) used to support closure structure or used as means for lifting the fireplace unit 10 and/or the unit 13. In the preferred embodiment of the present invention, the air conditioner 11 with its extension adapter 13, 13E attached thereto is mounted through wall 26 before mounting or stacking the fireplace unit 10 thereon. This simplifies the assembly of the combined units as well as making it easier to make critical and final adjustments.

Figure 4:
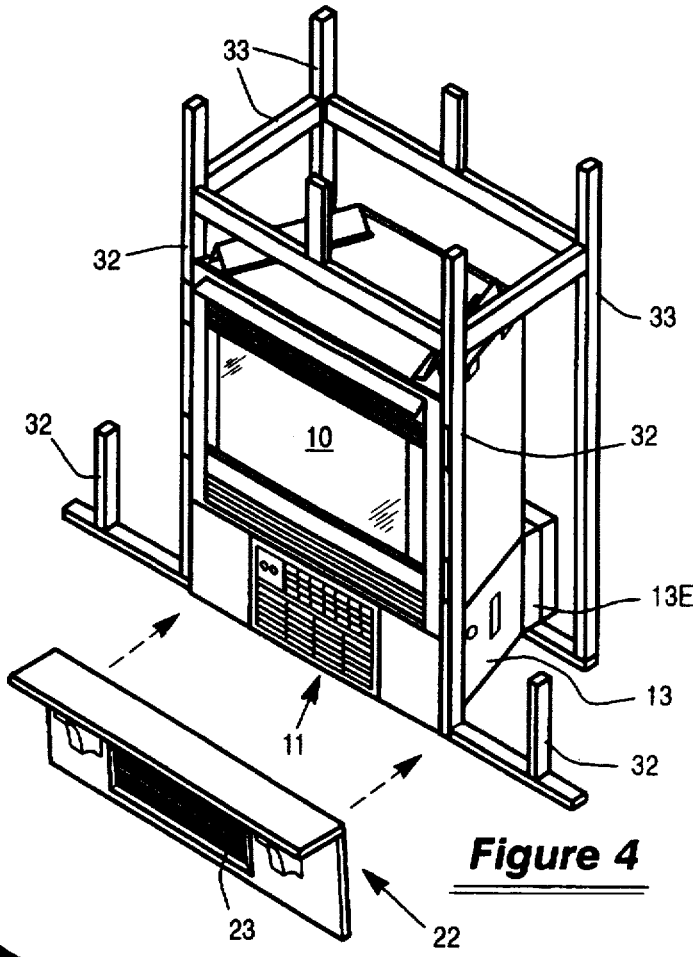
FIG. 4 is an isometric view of the combination unit shown in FIGS. 2 and 3 flush mounted through an outside wall and surrounded by a fabricated chaise.

Refer now to FIG. 4 showing an isometric view of the combination unit 12 shown in FIGS. 2 and 3 being flush mounted through an outside wall formed by wall studs 32 and surrounded by a fabricated chaise formed from chaise studs 33. The wall studs adjacent the units 10 and 11 form a mounting surface for a surround trim which will be explained in greater detail hereinafter. When a surround trim is used on the sides of the units 10 and 11, trim piece 22 is made wider to match up with the vertical lines of the surround trim.

Figure 5:
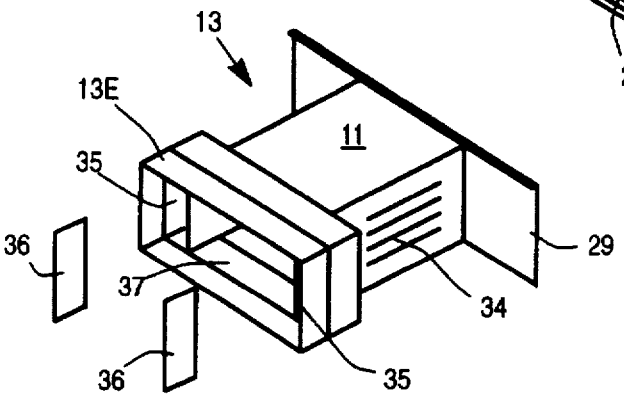
FIG. 5 is an isometric rear view of an air conditioner attached to a modified outside adapter.

Refer now to FIG. 5 showing an isometric view of the air conditioner adapter 13 having a telescopic extension 13E. The front decorative closure panel 29 is shown butting against the side of the air conditioner 11 which has side air inlet louvers 34. The interior of the telescopic extension 13E has a duct or passageway 35 which conducts fresh cooling air to louvers 35 and separates the fresh air entering the duct 35 to the sides of the air conditioner to enter air inlet louvers 34. The extension panels 36 are also slidably adjustable to accommodate the position of the telescopic extension 13E to further form the inlet for the ducts 35 at the sides of the discharge duct 37 formed at the center of the opening of the telescopic extension 13E. As will be explained, air entering through duct 35 passes through louvers 34 and cools the expansion or heating coil (not shown) and is exhausted through the discharge duct 37 as in the conventional cooling of a window type air conditioning unit.

Figure 6:
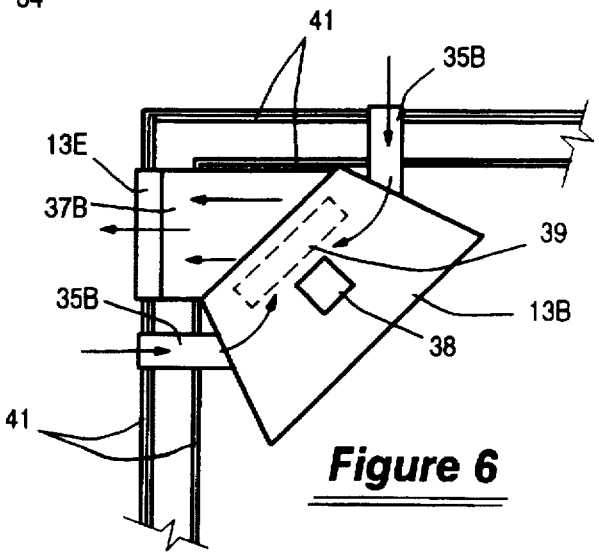
FIG. 6 is a top view of another modified air conditioner adapter illustrating an installation in a corner of two outside walls.

Refer now to FIG. 6 showing a top view of another modified air conditioner adapter 13B used in a corner of a room adjacent to outside walls. The inlet ducts 35 shown in FIG. 5 are shown numbered 35B in FIG. 6. The air which enters ducts 35B passes to the inside of the adapter shroud or cover 13B and is directed to cool the motor 38 as well as pass through the expansion coil 39 before being discharged out through the discharge duct 37B. The walls 41 are shown as exterior walls. The telescopic expansion extension 13E extends through an aperture in one of the walls 41 to provide venting and cooling of the air conditioner mounted inside of the extension adapter 13B.

Figure 7:
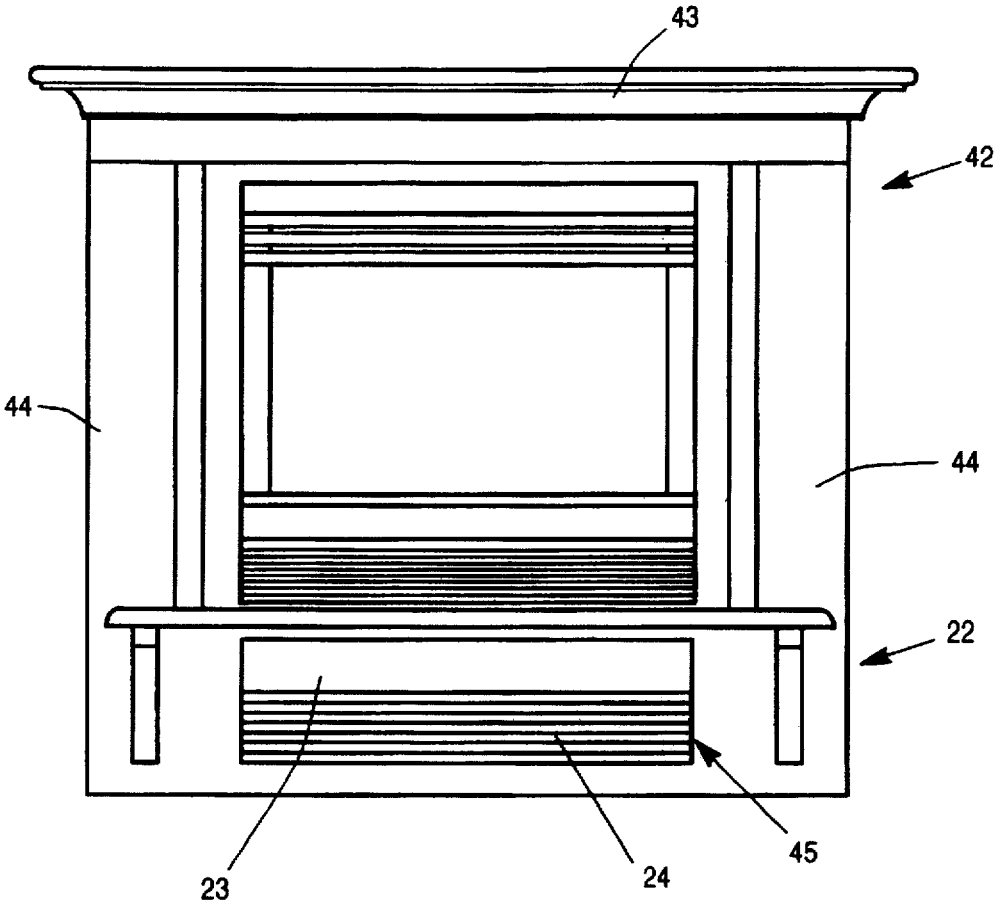
FIG. 7 is a front view of a combination unit mounted in a prefabricated cabinet showing an upper mantel. with surround trim and a lower removable mantel.

Refer now to FIG. 7 showing a front view of a combination unit mounted in a prefabricated cabinet 42 which comprises an upper mantel 43 and two side trim pieces or surround trim pieces 44. It will be noted that the trim piece 22 appears as a decorative hearth and has an opening 45 to accommodate the previously described louvers 23 and 24.

Figure 8:
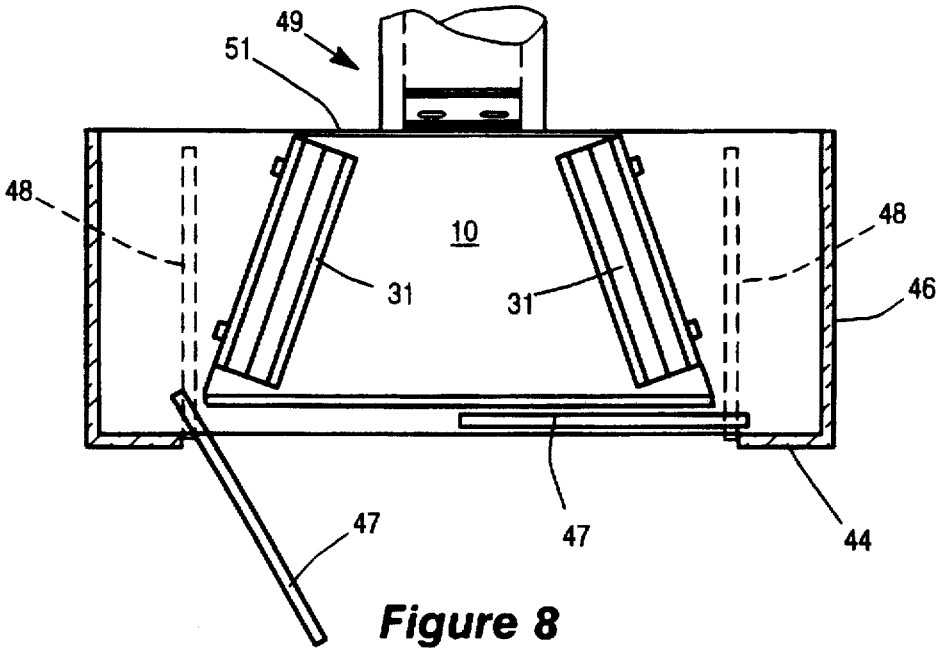
FIG. 8 is a top view of the prefabricated cabinet shown in FIG. 7.

Refer now to FIG. 8 showing a top view of the prefabricated cabinet 42 shown in FIG. 7. The front surround trim 44 is continuously formed and connected to side walls 46 which are spaced to accommodate pivoting and sliding doors 47 one shown and one shown in a closed position. When the doors 47 are not required, they may be pivoted and retracted into a concealed position shown by the phantom lines 48 which constitutes a retracted position. The fireplace unit 10 is further shown having vent means 49 which in the preferred embodiment comprises of pair of coaxial pipes attached through the rear panel 51 of the fireplace unit 10. It will be understood that other air vent and exhaust gas vents may be employed with the present invention gas fireplace unit when employing commercially available high efficiency gas fireplace units of the type known.

Figure 9:
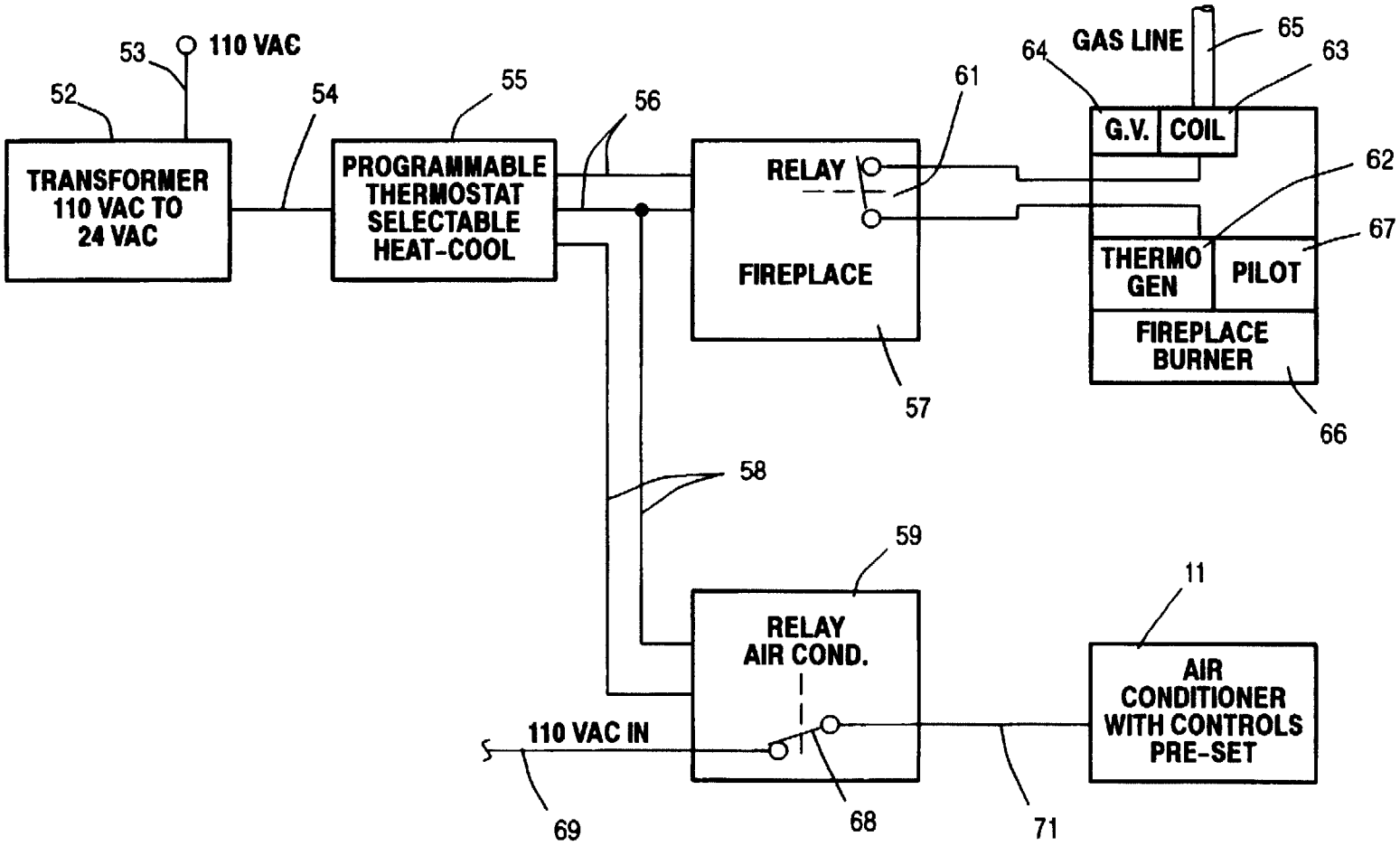
FIG. 9 is a schematic block diagram showing a preferred embodiment thermostatic control for a preferred operation of the combination unit.

Refer now to FIG. 9 showing a schematic drawing illustrating a preferred embodiment operation of the combination fireplace and air conditioning units. Transformer 52 is shown having a 110 volt AC source of electrical power on line 53 for producing a 24 volt AC output signal on line 54 which is coupled to a programmable thermostat 55 of the type preferably having a selectable onoff cool and heat control. The output of programmable thermostat 55 comprises a pair of control lines 56 coupled to a fireplace relay 57 and a second pair of control lines 58 coupled to an air conditioner relay 59. When the thermostat 55 calls for heat, the signal on control lines 56 engage the switch 61 of the relay 57 so as to form a continuous path from the thermogenerator 62 to the coil 63 of the gas valve 64 so as to open the gas line 65 to the fireplace burner 66. A continuous pilot light 67 ignites the burner 66.

In the event the programmable thermostat 55 generates a control signal on lines 58 calling for the air conditioner to provide cooling, the signal closes the switch 68 of relay 59 and effectively connects the 110 volt AC source of power on line 69 to the output line 71 which is the power source for the air conditioner 11. It will be understood that the air condition 11 is preferably set at a predetermined temperature or a maximum temperature so that when power is supplied to its input line 71, the air conditioner 11 automatically turns on. It is possible to set the thermostatic control on the air conditioner 11 to a predetermined temperature which will turn the air conditioner off when that temperature is reached or turn the temperature control in the air conditioner up to a max and allow the remote thermostat 55 to perform an on-off operation of the air conditioner 11 which effectively controls the temperature of the interior space.

Figure 10:
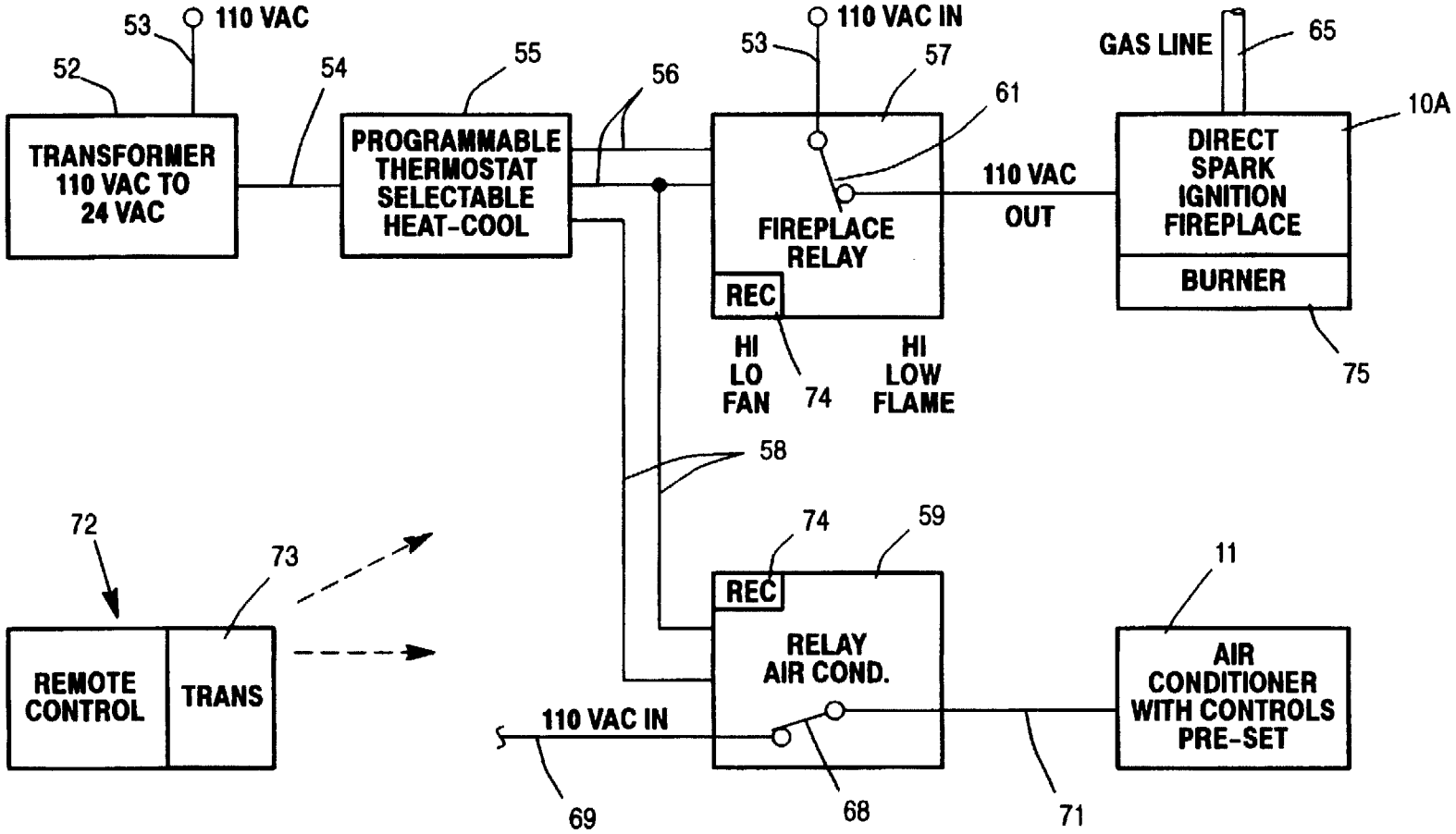
FIG. 10 is a schematic block diagram showing a second preferred embodiment gas fireplace unit and a remote control transmitter which may be used to override the thermostatic controls.

Refer now to FIG. 10 showing a schematic block diagram of a second preferred embodiment gas fireplace unit and a remote control transmitter 72 which may be used to override the thermostatic controls. In this embodiment, the elements and blocks which are identical to those previously described with reference to FIG. 9 are numbered the same and do not require additional detailed explanation. However, the control signal on lines 56 to the relay 57 now close switch 61 which connects a source of 100 volt AC power on line 53 to an output line which is directly connected to a spark ignition fireplace burner 10A. The burner 10A is normally in a off condition and when activated by the 110 volt AC power automatically turns on the burner 75. The burner 75 is of the type which is commercially available and preferably has additionally off-on and high-low controls. The signal on line 58 which activates the air conditioner relay 59 operates in the same manner as described hereinbefore and will not be described again. However, in the fireplace relay 57 and the air conditioner relay 59 there is also located a receiver 74 for receiving signals from remote control unit 72 which has a transmitter 73. The signals from this remote control transmitter will override the signals on control lines 58 as well as those signals on control lines 56 so as to activate the relays 59 and 57 respectively.

Another feature of the present invention is that the remote control 72 has a feature which in combination with the transmitter 73 and receiver 74 permits additional high-low fan controls and high-low flame controls in the burner 72.

Having explained a preferred embodiment of the present invention and several modifications thereof, it will now be understood that the standard stackable gas fireplace unit and window type air conditioning unit may be installed inside of a room to be heated and cooled and surrounded with a prefabricated cabinet or a custom cabinet or closure. Further, when the novel stackable heating and cooling unit is installed flush with the interior surface of an exterior wall it is possible to build a chaise or weather proof enclosure around the stackable unit which extends into the outside area and protects against outside weather conditions. A feature of the present invention is that a high efficiency low cost gas fireplace unit and air conditioning unit may be combined as a stackable unit and installed in the wall of a space to be heated and provide an aesthetically pleasant fireplace and cooling unit which was not available heretofore.

What is claimed is:

1. A combined air conditioner/fireplace unit for controlling the temperature of space air in an area or space adjacent to said unit comprising:

a prefabricated fireplace, a prefabricated air conditioner, a prefabricated enclosure having an upper compartment for housing said fireplace and a lower compartment for housing said air conditioner, said upper compartment of said enclosure having first front opening means for passageway of said space air through said prefabricated fireplace to provide heating of said space, said lower compartment of said enclosure having second front opening means for passageway of said space air through said prefabricated air conditioner, and thermostatic control means remote from said unit for controlling said prefabricated fireplace and said prefabricated air conditioner.

2. A combined air conditioner/fireplace unit as set forth in claim 1 which further includes a controller mounted in said unit for receiving control signals from said thermostatic control means and for controlling said air conditioner and said fireplace.

3. A combined air conditioner/fireplace unit as set forth in claim 2 wherein said controller comprises a remote wireless sensor and said thermostatic control means comprises a remote transmitter.

4. A combined air conditioner/fireplace unit as set forth in claim 3 wherein said controller in said unit comprises a manual override control.

5. A combined air conditioner/fireplace unit as set forth in claim 4 wherein said manual override control comprises means for simultaneously activating said air conditioner and said fireplace.

6. A combined air conditioner/fireplace unit as set forth in claim 1 wherein said fireplace is provided with first vent means for supplying fresh outside combustion air to said fireplace and for exhausting combustion gases from said fireplace.

7. A combined air conditioner/fireplace unit as set forth in claim 6 which further include a coaxial stack coupled to said vent means, said coaxial stack extending from said fireplace through a wall of the area to be heated.

8. A combined air conditioner/fireplace unit as set forth in claim 7 wherein said prefabricated enclosure and said fireplace are installed as a zero clearance fireplace backed up to said wall of said area.

9. A combined air conditioner/fireplace unit as set forth in claim 1 wherein said air conditioner is provided with second vent means for supplying fresh outside cooling air to said air conditioner and for exhausting the same air after being heated in said air conditioner by convection heating.

10. A combined air conditioner/fireplace unit as set forth in claim 9 which further includes duct means coupled to said second vent means.

11. A combined air conditioner/fireplace unit as set forth in claim 1 wherein said prefabricated enclosure comprises a support shelf between said upper and said lower compartments.

12. A combined air conditioner/fireplace unit as set forth in claim 1 wherein said prefabricated enclosure comprises a decorative shelf having a mantel trim at the top of said enclosure.

13. A combined air conditioner/fireplace unit as set forth in claim 12 which further includes insulation means mounted behind said decorative shelf.

14. A combined air conditioner/fireplace unit as set forth in claim 13 wherein said insulation means comprises a mat of insulation connected across the front of said prefabricated enclosure spaced apart from said decorative shelf to permit a flow of area space air therebetween for cooling said decorative shelf.

15. A combined heating and cooling unit, comprising:

an air conditioning unit, a gas fireplace unit mounted on top of said air conditioning unit, an air conditioner extension adapter coupled to said air conditioning unit, said extension adapter having a cooling air inlet duct and a hot air discharge duct for cooling said air conditioner, said extension adapter having means for extending said duct through an outside wall, and thermostatic control means in said combined heating and cooling unit comprising a fireplace switch and an air conditioning switch for actuating either said gas fireplace unit or said air conditioner unit in response to a remote thermostat control.

16. A combined heating and cooling unit as set forth in claim 15 wherein said thermostatic control means comprises a fireplace relay for actuating said fireplace switch in an ON/OFF mode of operation, and a programmable thermostat coupled to said fireplace relay for controlling the temperature of the space to be heated.

17. A combined heating and cooling unit as set forth in claim 15 wherein said thermostatic control means comprises an air conditioning relay for actuating said air conditioning switch in an ON/OFF mode of operation, and a programmable thermostat coupled to said air conditioning relay for controlling the temperature of the space to be cooled.

18. A combined heating and cooling unit as set forth in claim 16 wherein said programmable thermostat comprises a wireless transmitter and said thermostatic control means further comprises a wireless receiver coupled to said fireplace switch.

* * * * *